US006375138B1

(12) United States Patent
Balchan

(10) Patent No.: US 6,375,138 B1
(45) Date of Patent: Apr. 23, 2002

(54) STANCHION CLAMP APPARATUS

(76) Inventor: Ron Balchan, 83-175 Ave. 51, Coacheila, CA (US) 92236

( * ) Notice: Subject to any disclaimer, the term of this patent is extended or adjusted under 35 U.S.C. 154(b) by 0 days.

(21) Appl. No.: 09/628,956

(22) Filed: Jul. 29, 2000

(51) Int. Cl.[7] ..... G09F 7/18
(52) U.S. Cl. ..... 248/229.21; 248/229.15
(58) Field of Search ..... 248/229.21, 535, 248/539, 229.11, 229.15, 229.25, 228.2, 228.6

(56) References Cited

U.S. PATENT DOCUMENTS

| | | | | | |
|---|---|---|---|---|---|
| 419,379 | A | * | 1/1890 | Talbot | 248/229 |
| 473,073 | A | * | 4/1892 | Lemaire | 248/229.11 |
| 1,227,738 | A | * | 5/1917 | Bleecker | 248/229.11 |
| 2,233,911 | A | * | 3/1941 | Carson | 248/226 |
| 2,483,012 | A | * | 9/1949 | Koon | 248/42 |
| 3,178,144 | A | * | 4/1965 | Kimoto | 248/229 |
| 3,656,747 | A | * | 4/1972 | Revell, Jr. et al. | 273/95 |
| 4,264,048 | A | * | 4/1981 | Silbernagel | 248/229 |
| 4,568,052 | A | | 2/1986 | Solomon et al. | 248/281.1 |
| 5,383,636 | A | * | 1/1995 | Karl | 248/278 |
| 5,582,384 | A | | 12/1996 | Scheon | 248/536 |
| 5,664,904 | A | | 9/1997 | Hapgood et al. | 403/389 |
| 5,690,604 | A | * | 11/1997 | Barnett | 600/38 |
| 5,823,657 | A | * | 10/1998 | Price et al. | 362/191 |
| 5,934,016 | A | | 8/1999 | Jones | 47/41.01 |
| 6,017,008 | A | | 1/2000 | Farley | 248/229.21 |

* cited by examiner

*Primary Examiner*—Ramon O. Ramirez
*Assistant Examiner*—A. Joseph Wujciak
(74) *Attorney, Agent, or Firm*—Michael I. Kroll

(57) ABSTRACT

The present invention 10 discloses a clamp apparatus designed for attachment to the edge of a planar surface 12 which enables various stanchion items 14 to be attached such as a canopy, signs, umbrellas, displays, lighting and the like. The present invention includes an adjustable clamp assembly 40 for attachment to a planar surface and a stanchion holding member 19 having a stanchion bore 20 passing therethrough for receiving a stanchion 14 that is selectively positioned and locked in place by a cam lever 22. The clamp assembly 40 attachment includes a clamp frame channel 28 in which a pair of threaded retention knobs 24 are held captive in the lower lip of the channel portion. The threaded retention knobs 24 and cinch fingers 27 are the means of clamping the device to the planar surface 12. The head 42 of the cam lever 22 mechanism partially extends into the stanchion bore 20 when in the closed position thereby releasably gripping the stanchion 14 between the cam lever head 42 and stanchion bore wall 46. The present invention 10 also includes a removable plastic cover 16 for aesthetic purposes. The plastic cover 16 has an attachment means 44 for attachment to the clamp assembly 40 as required.

9 Claims, 7 Drawing Sheets

STANCHION CLAMP APPARATUS

BACKGROUND OF THE INVENTION

1. Field of the Invention

The clamp apparatus of the present invention is designed to attach to the edge of a planar surface which enables various stanchion items to be attached such as a canopy, signs, umbrellas, displays, lighting and the like. The clamping device of the present invention includes an adjustable clamp assembly for attachment to a planar surface and a stanchion bore wherein there is a stanchion bore passing therethrough which receives a stanchion that is selectively positioned and locked in place by a cam lever. The clamp assembly attachment includes a clamp frame channel in which two threaded retention knobs are held captive in the lower lip of the channel portion. The threaded retention knobs are the means of clamping the device to the planar surface. The cam lever mechanism partially extends into the stanchion bore when in the closed position thereby gripping the stanchion between the cam lever and stanchion bore wall releasably. The present invention also includes a removable plastic cover for aesthetic purposes. The plastic cover may clip onto or be removed from the clamp assembly as required.

2. Description of the Prior Art

There are other clamping devices designed for the purpose of attachment. Typical of these is U.S. Pat. No. 6,017,008 issued to Daniel K. Farley on Jan. 25, 2000.

Another patent was issued to Robin Hapgood, et al. on Sept. 9, 1997 as U.S. Pat. No. 5,664,904. Yet another U.S. Pat. No. 5,934,016 was issued to Jill Marie Jones on Aug. 10, 1999 and still yet another was issued on Feb. 4, 1986 to Jack Solomon as U.S. Pat. No. 4,568,052.

Another patent was issued to Hans Schoen on 5,582,384 as U.S. Pat. No. 5,582,384.

U.S. PATENT NUMBER 6,017,008

Inventor: Daniel K. Farley

Issued: Jan. 25, 2000

A clamping apparatus included a shaft member with a first clamping member and a second clamping member mounted on the shaft member. Both of the clamping members have leg portions that are moveable toward and away from each other between a clamping and non-clamping position. The clamping apparatus further includes a cam member engaging the shaft member that urges the clamping members between their clamping and non-clamping positions. Embodiment, the joint mechanism includes a locking mechanism for permitting quick adjustment of the joint clamp componets relative to each other.

U.S. PATENT NUMBER 5,664,904

Inventor: Robin Hapgood

Issued: Sept. 9, 1997

A clamping for connecting together two parellel elongate members has a pair of body parts with respective recesses that can be brought together to define a through opening receiving one of the members. To one side of the through opening each body part has spaced tubular portions with coaxial bores. The tubular portions of the body parts can be meshed together to alien their bores and the other of the elongate members inserted through the bores to lock the body parts together axially but allowing them to pivot on the farther member. To the opposite side of the through opening the body parts have snap-fastening recesses that engage a clamping lever. Cam mechanisms between the clamping lever and the body parts to be flexed together by pivoting the leaver, so gripping both elongate members and locking them together.

U.S. PATENT NUMBER 4,568,052

Inventor: Jack Solomon

Issued: Feb. 4, 1986

Each arm of the first pair of arms is pivotally connected at space apart pivot locations to the first clamp bracket and to an adjustment bracket, respectively, and each arm of a second pair of arms is pivotally connected at spaced apart locations to a second clamp bracket and to the adjustment bracket, respectively. A first control is engageable with an arm of the first pair for selectively enabling and preventing pivoting movement thereof, and a second control is engageable with an arm of the second pair for selectively enabling and preventing pivoting movement thereof. When the first and second controls both enable the respective pivoting movements, the second clamp bracket can be moved to a desired to a desired position, and, when the first and second controls both prevent the respective pivoting movement, the second clamp bracket retains its position.

U.S. PATENT NUMBER 5,582,384

Inventor: Hans Schoen

Issued: Dec. 10, 1996

A holding device for elongate members has a base body with a C-shaped bracket with a first leg, a second leg, and a connecting bar. The C-shaped bracket has a securing screw extending through the first leg for clamping the holding device to a support. The base body has two parallel legs extending in a first plane of the first leg and pointing away from the C-clamp bracket. A plate is positioned in a second plane perpendicular to the first plane and is connected with adjacent edges to the connecting bar and the two parallel legs. The plate has a first and second set of two grooves that extend parallel to one another on opposite sides of the plate. The first and second sets extend spaced from one another parallel to the connecting bar. The plate further has a third and fourth set of two grooves that extend parallel to one another on opposite sides of the plate. The third and fourth sets extend spaced from one another parallel to the two parallel legs. At least one annular member for clamping an elongate member is provided. It has a radial gap defining two oppositely arranged free ends of the annular member from which extend two flanges radially outwardly. The two parallel legs and the sets of two grooves are receiving elements for the annular member wherein the annular member is slipped onto one of the receiving elements. An arresting pin arrests the annular member on the receiving element.

While these clamping devices may be suitable for the purposes for which they were designed, they would not be as suitable for the purposes of the present invention, as hereinafter described. It is thus desirable to provide a clamping apparatus which may secure to a planar surface and receive attaching apparatus such as a canopy assembly as well other mounting devices. It is further desirable to provide a clamping device that may adjust to the thickness of selected planar surface.

SUMMARY OF THE PRESENT INVENTION

The present invention discloses a clamp apparatus designed for attachment to the edge of a planar surface which enables various stanchion items to be attached such as a canopy, signs, umbrellas, displays, lighting and the like. The present invention includes an adjustable clamp assembly for attachment to a planar surface and a stanchion holding member having a stanchion bore passing therethrough for receiving a stanchion that is selectively positioned and locked in place by a cam lever. The clamp assembly attachment includes a clamp frame channel in which a pair of threaded retention knobs are held captive in the lower lip of the channel portion. The threaded retention knobs are the means of clamping the device to the planar surface. The head of the cam lever mechanism partially extends into the stanchion bore when in the closed position thereby releasably gripping the stanchion between the cam lever head and stanchion bore wall. The present invention also includes a removable plastic cover for aesthetic purposes. The plastic cover has an attachment means for attaching to the clamp assembly as required.

A primary object of the present invention is to provide a clamping device for various planar surfaces.

Another object of the present invention is to provide a clamping device for various planar surfaces such as banquet tables and enable various items to be attached.

Yet another object of the present invention is to provide a clamping device for various planar surfaces such as banquet tables and enable various items to be attached. Also, to provide a device consisting of a cam lever for securing attachable apparatus thereto.

Still yet another object of the present invention is to provide a clamping device for planar surfaces such as banquet tables and enable various items to be attached. Also a device consisting of a cam lever for securing attachable apparatus using a pole insert vertically mounted.

Yet another object of the present invention is to provide a device consisting of a cam lever for securing attachable apparatus using a pole insert vertically mounted into the stanchion opening.

Additional objects of the present invention will appear as the description proceeds.

The present invention overcomes the shortcomings of the prior art by providing a clamp designed to attach to a planar surface such as a banquet table and enable various items to than be attached via a pipe/pole inserted vertically into the stanchion portion of the present invention.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
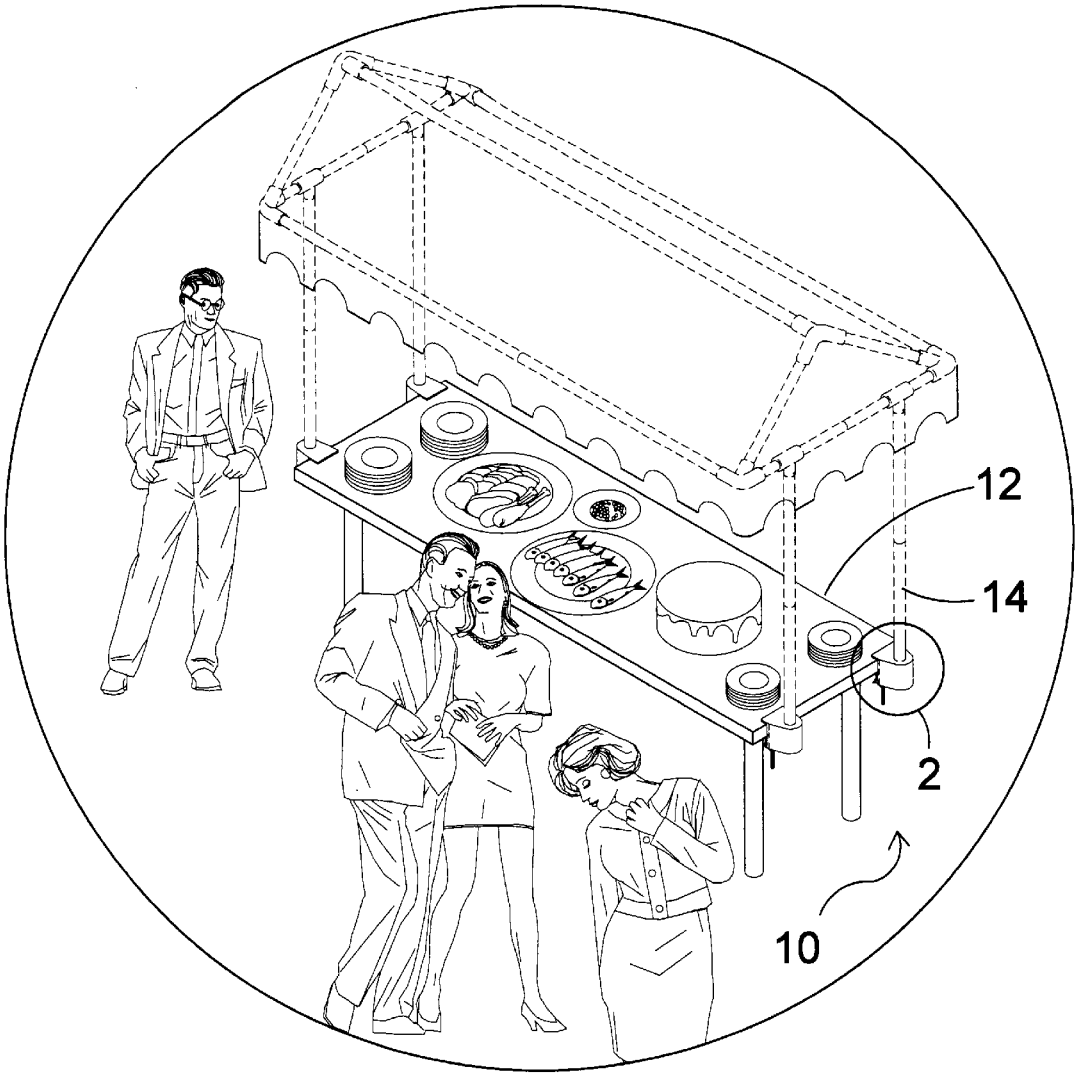
FIG. 1 is a pictorial view depicting a banquet affair using the clamping device of the present invention mounted to the banquet table.

With regard to reference numerals used, the following numbering is used throughout the drawings.

10 present invention
12 table
14 stanchion
16 cover
18 cover aperture
19 stanchion holding member
20 stanchion bore
22 cam lever
24 cinch knob
25 back side of C clamp
26 C clamp
27 cinch finger
28 channel
30 fasteners
32 pivot pin
34 lock ring
36 gusset
40 clamp assembly
42 head of cam lever
44 cover attachment means
46 stanchion holding member wall
48 aperture
50 leg-like members
52 opening

DESCRIPTION OF THE PREFERRED EMBODIMENT(S)

In order that the invention may be more fully understood, it will now be described, by way of example, with reference to the accompanying drawings in which FIGS. 1 through 7 illustrate the present invention being a stanchion clamp apparatus Turning to FIG. 1, shown therein is a pictorial view depicting a banquet affair using the clamping device of the present invention 10 mounted to the banquet table 12 having a stanchion 14 inserted therein.

Figure 2:
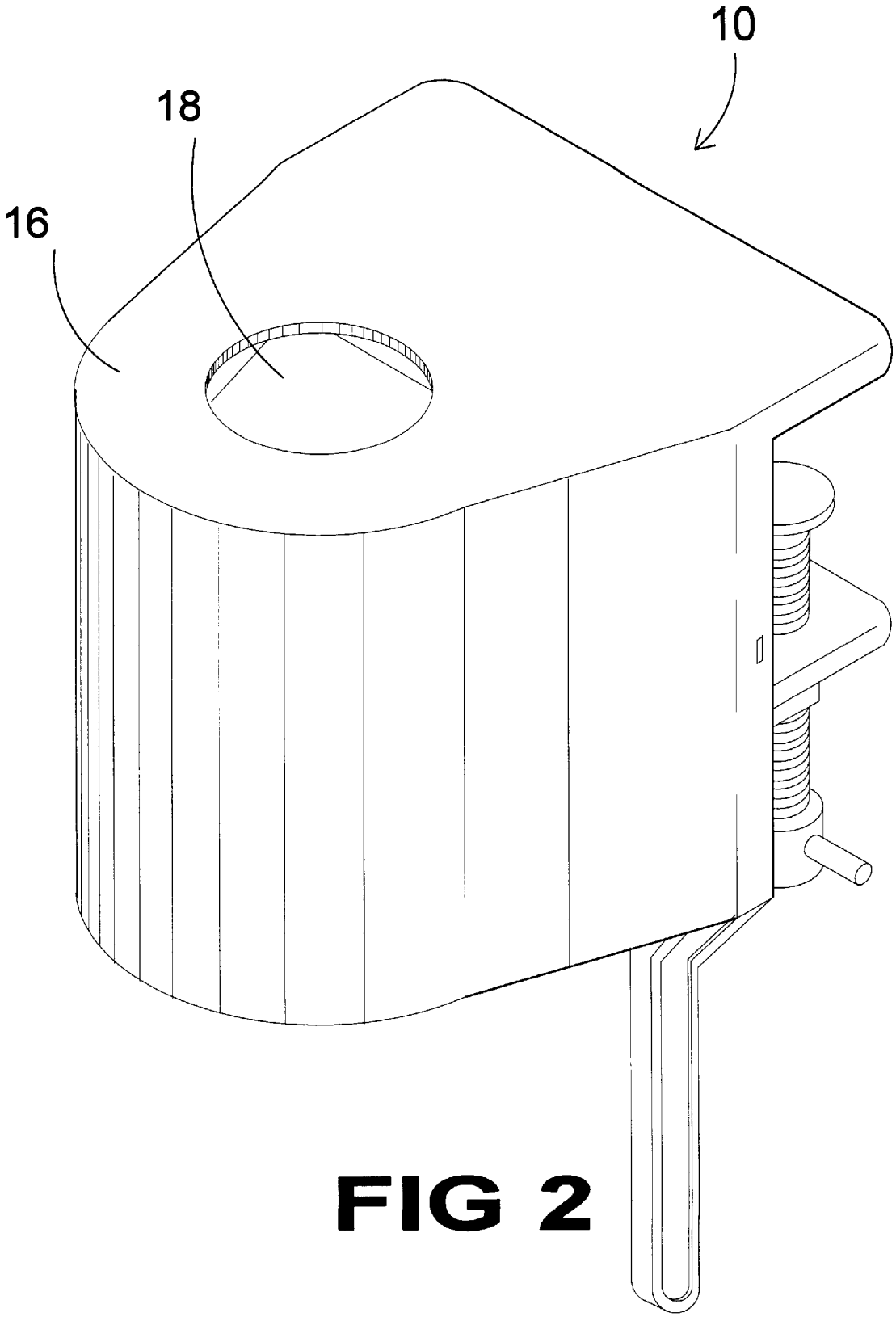
FIG. 2 is a perspective view of the present invention showing the exterior of the plastic cover and partial view of the exterior of the clamping device of the present invention.

Turning to FIG. 2, shown therein is a perspective view of the present invention 10 showing the exterior of the plastic cover 16 having an aperture 18 therein for receiving a stanchion and partial view of the exterior of the clamping device of the present invention.

Figure 3:
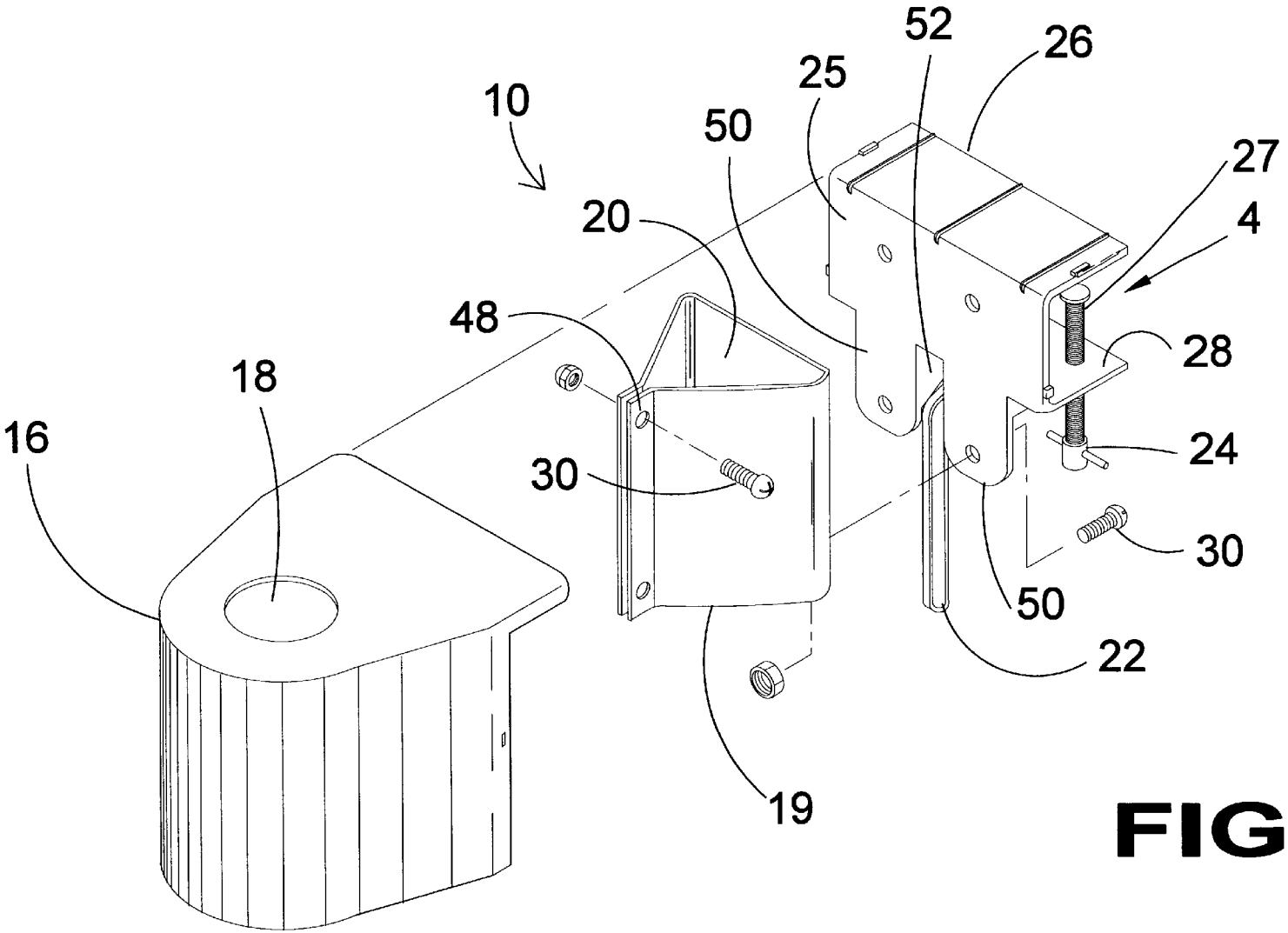
FIG. 3 is an exploded view or the clamp device of the present invention. Shown are the various components; plastic cover, stanchion bore, cam lever, cinch knob, C-clamp and channel.

Turning to FIG. 3, shown therein is an exploded view of the clamp device of the present invention 10. Shown are the various components; plastic cover 16 with aperture 18, stanchion holding member 19, stanchion bore 20, cam lever 22, cinch knob 24, C-clamp member 26 with threaded clamp or cinch finger 27 and channel 28. Threaded fasteners 30 or the like are also shown for attaching the back side 25 of the C clamp 26 to the stanchion holding member 19 and for adjustably closing the stanchion bore 20 about the stanchion on its side having apertures 48 therein. C clamp 26 has a pair of downwardly extending leg-like members 50 forming an opening 52 therebetween for receiving the head of cam lever 22 with a mating opening (not shown) being in the wall of stanchion holding member 19 for receiving the head of cam 22.

Figure 4:
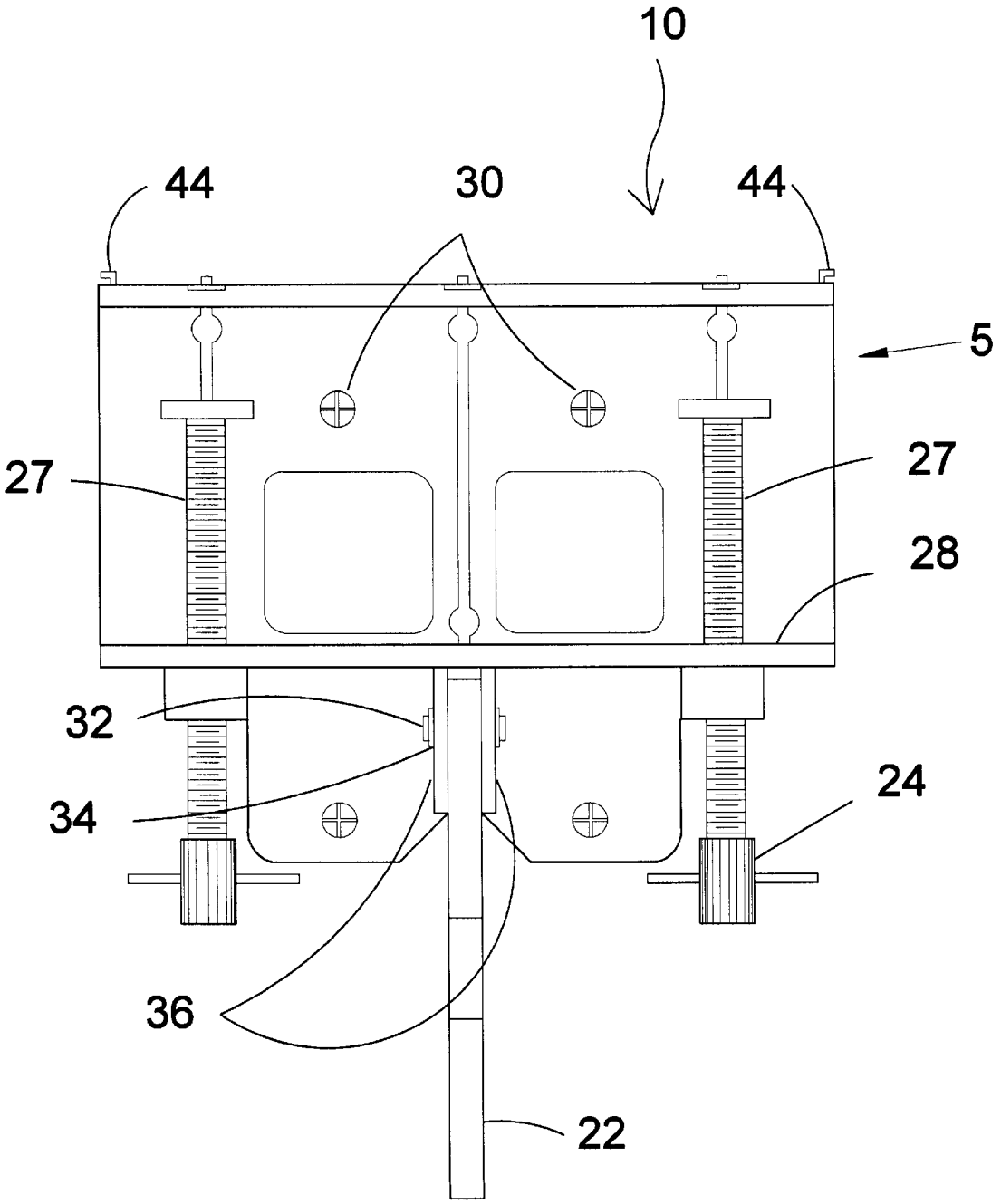
FIG. 4 is a rear view of the present invention with the plastic cover removed for clarity. Shown, the pivot pin, lock ring, gusset, cam lever, cinch knob and clamp channel.

Turning to FIG. 4, shown therein is a rear view of the present invention 10 with the plastic cover removed for clarity. Shown are the pivot pin 32, lock ring 34, gusset 36, cam lever 22, cinch knob 24 and clamp channel 28. Multiple fasteners 30 are also shown. Cover attachment means 44 is also shown. Other elements previously disclosed are also shown.

Figure 5:
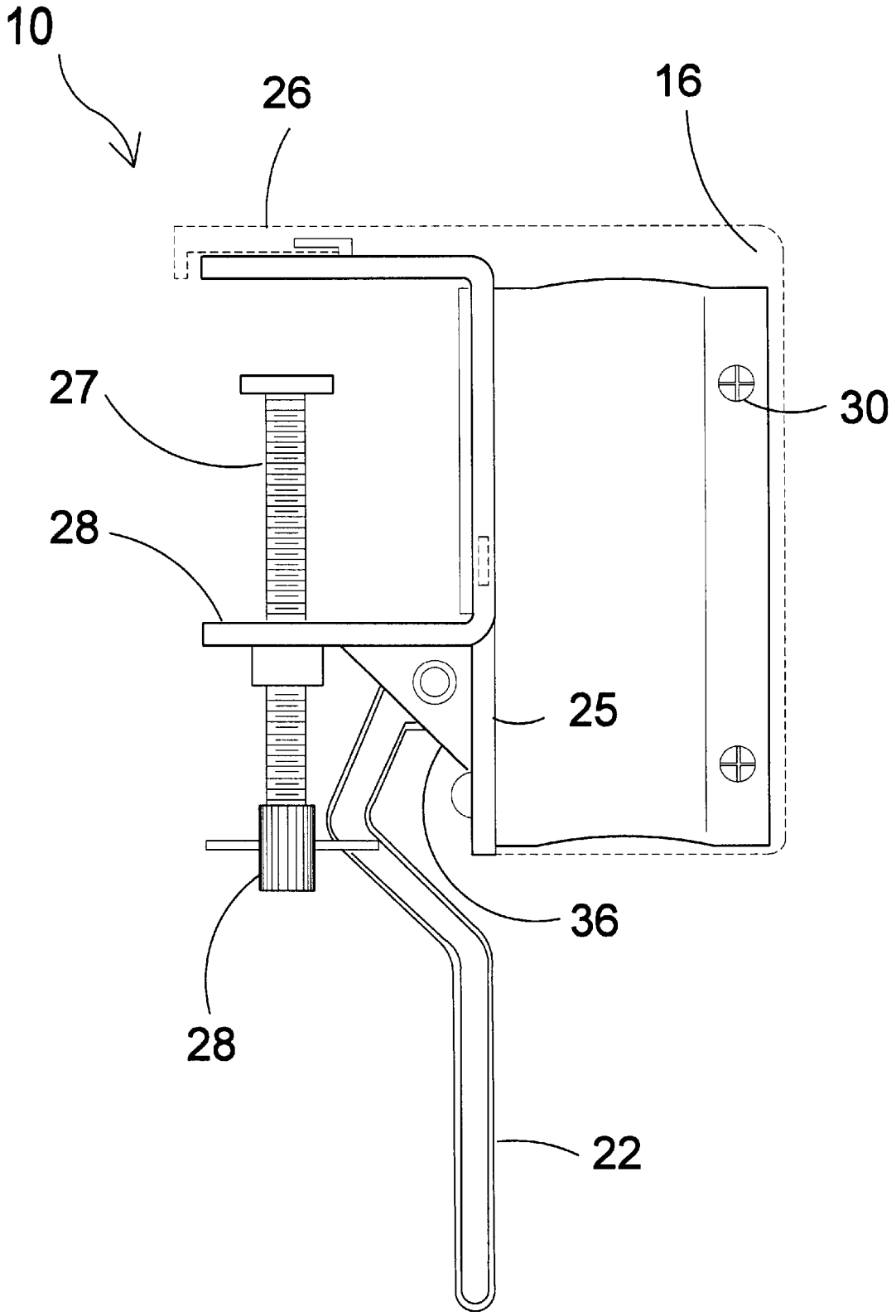
FIG. 5 is a side view of the present invention showing the channel, cinch knob, gusset, and plastic cover in an assembled position.

Turning to FIG. 5, shown therein is a side view of the present invention 10 showing the channel 28, cinch knob 24 and finger 27, gusset 36 forming a brace between the channel 28 and back side 25 of the C clamp 26, cam lever 22, fastener 30 and plastic cover 16 in an assembled position.

Figure 6:
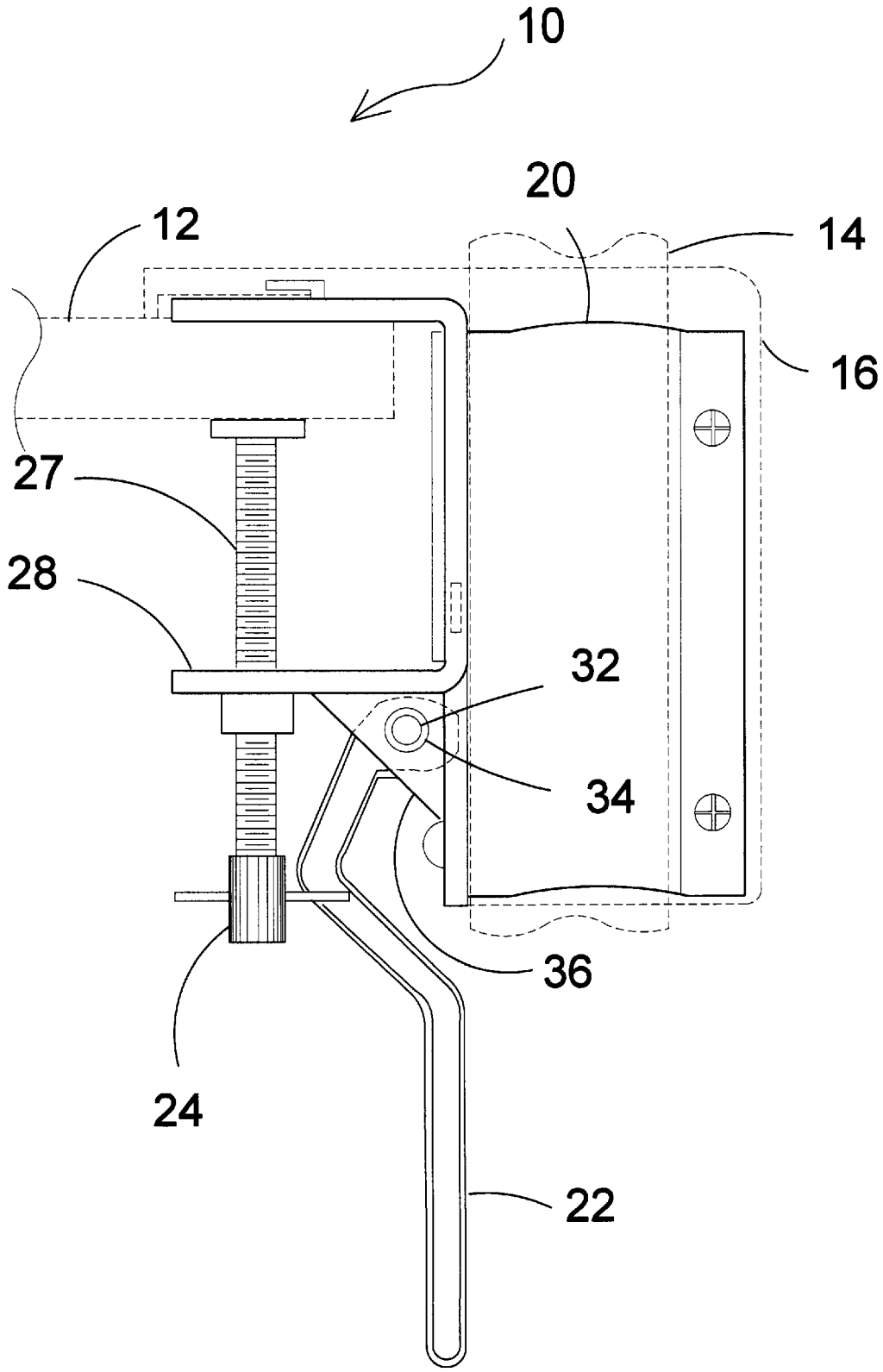
FIG. 6 is a side view of the present invention with the cam lever in the open position freeing the stanchion opening for receiving attaching pole. The clamping cinch knobs are illustrated attached to a table top.

Turning to FIG. 6, shown therein is a side view of the present invention 10 attached to a table 12 with the cam lever in the open position freeing the stanchion opening 20 for receiving an attached pole or stanchion 14. The clamping cinch knobs 24 and finger 27 are illustrated attached to a table top 12. Also shown are the cover 16, gusset 36 and pivot pin 32 with lock ring 34.

Figure 7:
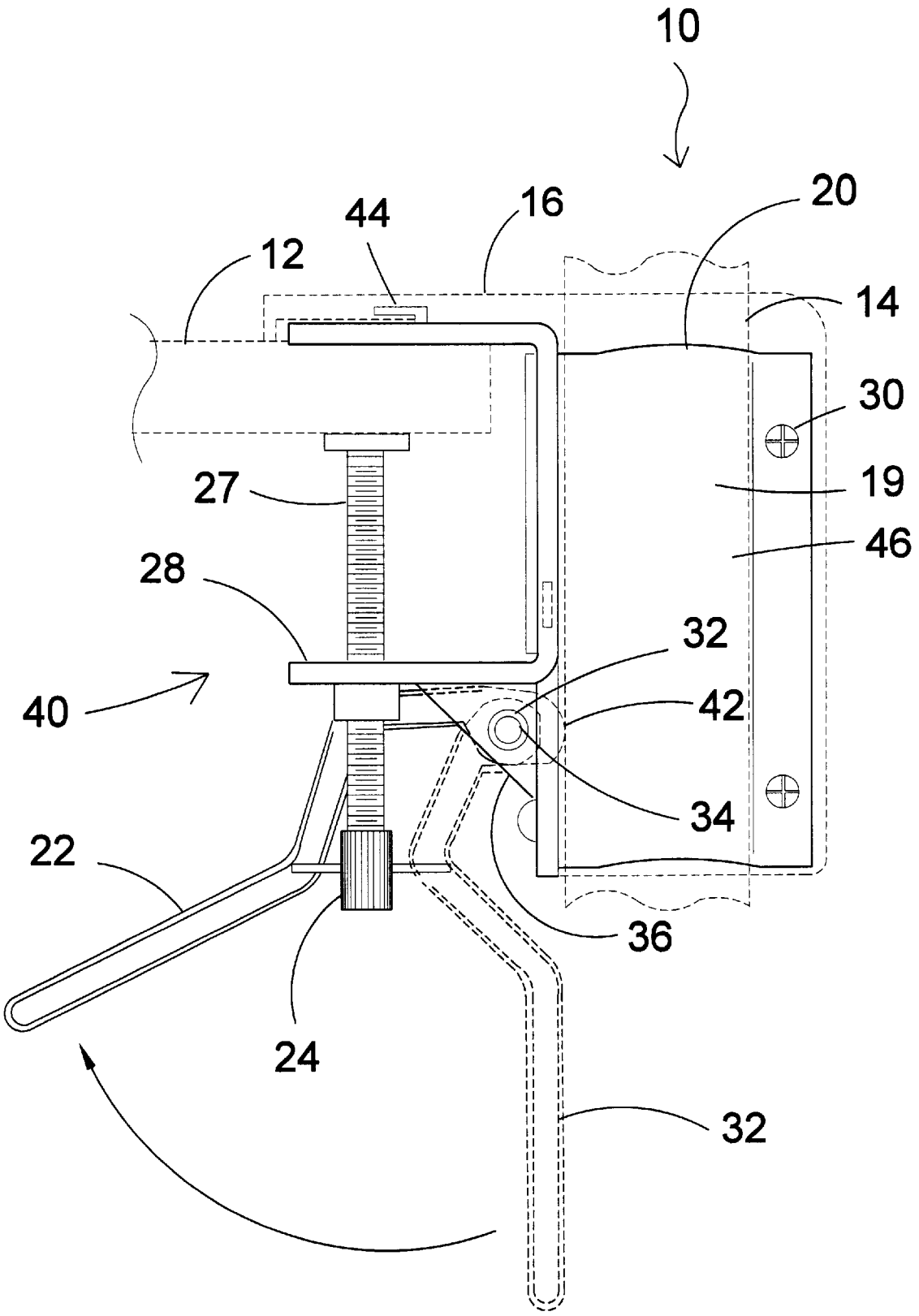
FIG. 7 is a side view of the present invention with the cam lever in closed position with the cam lever locking down on the inserted pole. The clamping cinch knobs are shown attached to a table top.

Turning to FIG. 7, shown therein is a side view of the present invention 10 with the cam lever 22 in the closed position with the cam lever locking down on the inserted pole or stanchion 14 The clamping cinch knobs 24 are shown attached to a table top 12. Other elements previously disclosed are also shown. The present invention 10 discloses a clamp apparatus designed for attachment to the edge of a planar surface 12 which enables various stanchion items 14 to be attached such as a canopy, signs, umbrellas, displays, lighting and the like. The present invention includes an adjustable clamp assembly 40 for attachment to a planar surface and a stanchion holding member 19 having a stanchion bore 20 passing therethrough for receiving a stanchion 14 that is selectively positioned and locked in place by a cam lever 22. Fasteners 30 allow the diameter of the stanchion bore 20 to be adjusted. The clamp assembly 40 attachment includes a clamp frame channel 28 in which a pair of threaded retention knobs 24 are held captive in the lower lip of the channel portion. The threaded retention knobs 24 and cinch fingers 27 are the means of clamping the device to the planar surface 12. The head 42 of the cam lever 22 mechanism partially extends into the stanchion bore 20 when in the closed position thereby releasably gripping the stanchion 14 between the cam lever head 42 and stanchion bore wall 46. The present invention 10 also includes a removable plastic cover 16 for aesthetic purposes. The plastic cover 16 has an attachment means 44 for attachment to the clamp assembly 40 as required.

What is claimed to be new and desired to be protected by Letters Patent is set forth in the appended claims.

I claim:

1. An apparatus for holding a stanchion which apparatus can be clamped to the edge of a planar surface, comprising:

a) a "C" clamp member having an upper lip and a lower lip, said "C" clamp member having a backside;

b) a channel disposed between said upper lip and said lower lip of said "C" clamp for receiving the edge of a planar surface;

c) a threaded cinch finger disposed on said lower lip of said "C" clamp for attaching said "C" clamp to the edge of the planar surface;

d) a stanchion holding member disposed on said backside of said "C" clamp, said member having a bore therein for receiving the stanchion;

e) means for a cam lever pivotally disposed on said lower lip of said "C" clamp whereby a stanchion is removably secured internal said stanchion holding member, said cam lever having a first end and a second end;

f) means comprising threaded fasteners for fastening said stanchion holding member to said backside of said "C" clamp;

g) means for adjustably securing said stanchion holding member about the stanchion whereby the diameter of the stanchion bore is variable, said stanchion holding member having an opening in its wall, said opening receiving said first end of said cam lever;

h) a pair of downwardly extending gussets disposed between said lower lip of said "C" clamp member and said stanchion holding member, said opening in said stanchion holding member disposed between said pair of gussets; and, i) each of said pair of gussets having a means for a pivot disposed therein whereby said cam lever is pivotally disposed thereon.

2. The apparatus of claim 1, further comprising a cover for the apparatus, said cover having means for attachment to the apparatus.

3. The apparatus of claim 2, said means for attachment further comprising clips disposed on said upper lip of said "C" clamp member.

4. The apparatus of claim 3, said cover having an aperture therein, said aperture being in operative alignment with said bore of said stanchion holding member so that the stanchion passes through said aperture.

5. The apparatus of claim 1, wherein there are a pair of said threaded cinch fingers.

6. The apparatus of claim 5, further comprising a cinch knob disposed on each cinch finger for turning said cinch finger.

7. The apparatus of claim 1, wherein said means for a pivot further comprises a pivot pin disposed in said pair of gussets and a pair of locking rings for holding said pivot pin in said pair of gussets.

8. The apparatus of claim 7, further comprising said first end of said cam lever being a cam head and said second end of said cam lever being a handle for gripping by a user.

9. The apparatus of claim 8, wherein said cam head of said cam lever communicates with the stanchion, said stanchion being disposed adjacent said opening in said stanchion holding member, said stanchion being secured in said stanchion holding member by being contacted by said cam head.

* * * * *